United States Patent [19]

Kellogg-Smith

[11] 4,382,416

[45] May 10, 1983

[54] DETACHABLE NESTABLE MAST STEPS

[76] Inventor: Ogden Kellogg-Smith, 226 Haverton Rd., Arnold, Md. 21012

[21] Appl. No.: 235,115

[22] Filed: Feb. 17, 1981

[51] Int. Cl.[3] ..... A47F 5/00

[52] U.S. Cl. ..... 114/90; 114/363; 248/222.3

[58] Field of Search ..... 114/90, 94, 363; 182/92, 100; 248/73, 222.3, 222.2, 243

[56] References Cited

U.S. PATENT DOCUMENTS

| | | | |
|---|---|---|---|
| 1,140,940 | 5/1915 | Bales | 248/222.3 |
| 1,803,016 | 4/1931 | Harsted | 248/221.2 |
| 3,313,509 | 4/1967 | Lockert | 248/222.3 |
| 3,476,344 | 11/1969 | Pace | 248/222.3 |
| 3,880,390 | 4/1975 | Niven | 248/222.3 |
| 4,274,614 | 6/1981 | Worrallo | 248/243 |

*Primary Examiner*—Trygve M. Blix
*Assistant Examiner*—C. T. Bartz
*Attorney, Agent, or Firm*—Schwartz, Jeffery, Schwaab, Mack, Blumenthal & Koch

[57] ABSTRACT

Mast steps that may be attached to any vertical spar or surface when needed for climbing said spar or surface, and removed and nested for easy storage when not in use.

8 Claims, 14 Drawing Figures

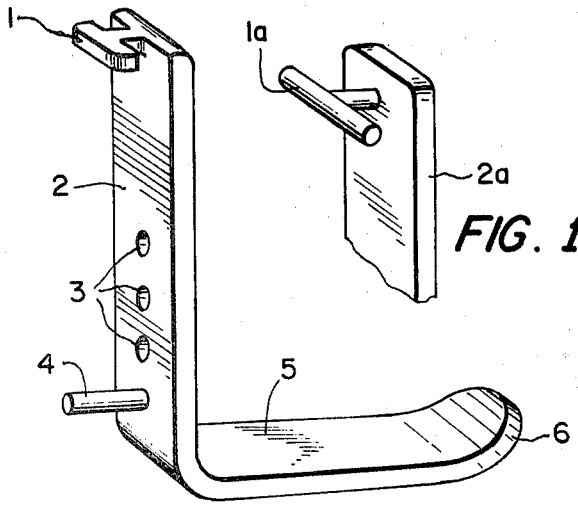
FIG. 1
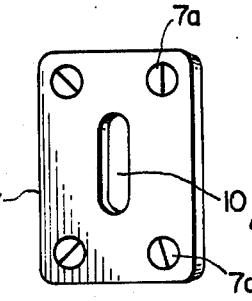
FIG. 1A
FIG. 2
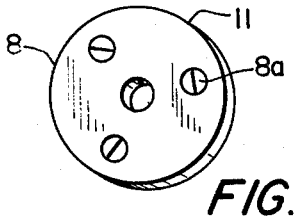
FIG. 2A
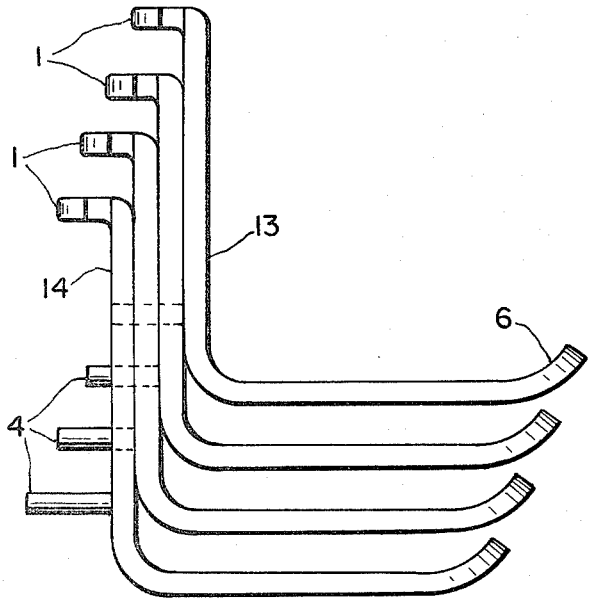
FIG. 3
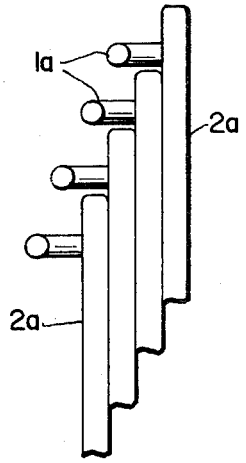
FIG. 3A

DETACHABLE NESTABLE MAST STEPS

BACKGROUND OF THE INVENTION

1. Field of the Invention

The invention relates to mast steps, and more particularly to detachable, nestable steps for engaging a sailboat mast.

2. Prior Art

It has been previously proposed to construct a detachable step for the purpose of climbing a mast, spar or other structure. That can be removed and stored when not in use. Such prior art proposals, however, were of complicated design requiring a permanent attachment to the mast as illustrated in U.S. Pat. No. 3,930,562. The attachments required protruding brackets attached to the mast for the purpose of receiving the removable step. Such an arrangement providing permanently mounted projecting hardware on the mast can cause catching or chafing of lines and sails, increased wind resistance added weight aloft, weakening by corrosion at the fittings, an impediment to cleaning and refinishing the mast, and a cluttered appearance.

Prior art such as U.S. Pat. Nos. 186,424 and 3,930,562 included steps having a closed configuration making it necessary to grope for the step with the foot, particularly upon descending, as is necessary in finding an unseen stirrup, rather than letting the foot slide down the mast, being guided by it, until it rests firmly in the step.

Other prior proposals did not provide for compact nesting for the steps for easy hand holding of a group of steps, as well as for compact storing of the steps when not in use.

Prior art detachable steps, such as U.S. Pat. No 3,930,562, also required a complicated locking system to prevent the step from becoming completely detached from the mast when accidentally moved upward.

OBJECTS OF THE INVENTION

It is, therefore, an object of this invention to provide detachable steps which can be used on generally vertical masts, spars and surfaces, and which can be easily attached by the climber as he ascends, and as easily detached as he descends.

A further object is to provide steps that are easy to find with the foot by sliding the foot down the mast or other structure until it meets the step and rests securely in its proper place, rather than having to grope for the proper place for the foot as with a stirrup.

Another object is to provide a step that can be used on hollow aluminum masts now popular without having to install hardware on the mast, thus eliminating the possibility of dangerous corrosion caused by the attachment of permanent hardware and/or fastenings made of metal that is incompatible with the metal from which the mast is made, making no addition to the weight and windage aloft from the weight and protrusion of hardware, and eliminating chafing, snagging or tearing of sails and rigging on protrusions.

A still further object is to provide a mast step system for wooden or other masts or structures by fashioning two metal plates into which have been cut a slot in one for a "T", and a hole in the other for a pin. These plates may be recessed into the mast or structure and fastened with screws, or bolts or welds leaving no protrusions on the mast. All of the advantages described herein are retained with the use of these plates except that there would be a minimum of weight added aloft from the plates themselves and their fastenings.

A further object is to provide a step that is not dependent upon welding to keep it attached to the mast. The T-shaped protrusion is not welded on, but an integral part of the step. In the event that the pin is welded, and the welding breaks the step will not become detached and remains usable even though it will be attached only at the top with the "T" in the slot.

A further object is to provide detachable mast steps that cannot be accidentally detached from the mast by being lifted vertically by a force or blow upward.

Another object is to provide attachments on the mast for eyes and hooks for attachment of temporary rigging for awings, water catchers, wind scoop, special or jury rigged sails, jury rigged mast supports and the like.

A further object is to provide steps that can nested for compact storage and convenient carrying when not in use.

A further object is to provide a step system that does not give the mast a permanent cluttered appearance.

A still further object is to provide a step system that does not hinder the cleaning and refinishing of a mast.

SUMMARY OF THE INVENTION

In general, the present invention comprises an L-shaped step made of metal or other material, one leg of the "L" being in a horizontal direction at right angles to the mast for the foot to rest upon, while the vertical leg of the "L" is held against the mast above the horizontal leg. The vertical leg has a T-shaped protrusion at its top which locks into the mast, the stem of the "T" being parallel to the horizontal leg of the step. At the lower end of the vertical leg is a pin having a diameter of about the thickness of the step, protruding from the step into a hole in the mast, the pin being about as long as the thickness of two or three steps. Above this pin are a series of holes evenly spaced with the pin, and being slightly larger than the diameter of the pin.

The mast has a round hole of an appropriate size and location to receive the pin located on the vertical leg of the step. There is on the mast a vertical slot of an appropriate size and location to receive the T-shaped protrusion at the top of the vertical leg of the step so that the stem of the "T" will come to rest at the bottom of the slot and the pin below will enter the appropriate hole in the mast.

The step is installed on the mast by inserting the cross of the "T" into the slot in the mast and then rotating the step 90 degrees down and inserting the pin into its hole in the mast. The step is detached from the mast by the opposite action, namely, by pulling it out of the hole in the mast, rotating it 90 degrees upward and removing the "T" from its slot.

In another embodiment two plates are provided which are used for mounting the steps on wood or other masts or structures. One of the plates contains an appropriate slot to receive the "T", and the other plate includes the appropriate hole for receiving the pin. These plates are mounted on the mast or structure, or recessed in it, and are placed so that they take the place of the slot and hole in a hollow spar, with appropriate altering of the mast or structure so that the pine and "T" function as intended.

The slots and holes in the mast provide places for the temporary attachment of eyes and hooks for use in rigging awnings, wind scoops, rain catchers, emergency sails and other rigging.

The steps are nested for storage or easy hand holding of a group of them by putting them together with correponding legs next to each other. The T's at the upper end of the step will stack in step fashion, while the pins at the lower end will protrude through the holes in the next adjacent steps.

The horizontal leg of the step has an upturned end to keep the foot from slipping off the step and to provide a hook function for the step for hanging a bucket or other items used in mast work.

BRIEF DESCRIPTION OF THE DRAWINGS

The foregoing and other objects, features and advantages of the invention will become apparent from the following detailed description and accompanying drawings wherein:

FIG. 1 is a perspective view of a step according to the instant invention;

FIG. 1A is a perspective view of a variation of the connecting protrusion of FIG. 1;

FIG. 2 is a front perspective vie of plates which may be used on wood or other masts or structures;

FIG. 3 is a side view of the steps nested for storage and carrying;

FIG. 3A is a side elevation view of the embodiment of FIG. 1A seen nested together.

DETAILED DESCRIPTION OF THE PREFERRED EMBODIMENTS

Figure 4:
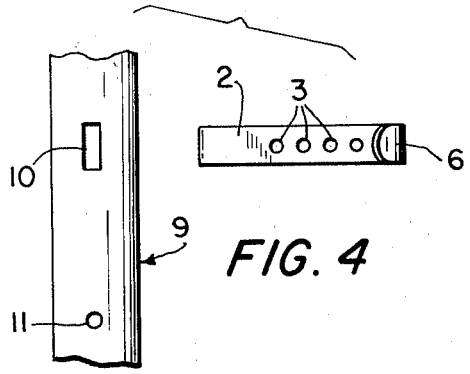
FIGS. 4–11 illustrate the action needed for attaching to and removing the steps from a mast.
Figure 8:
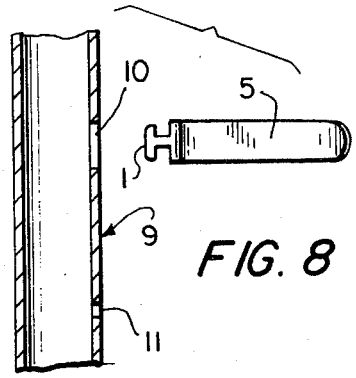
Figure 5:
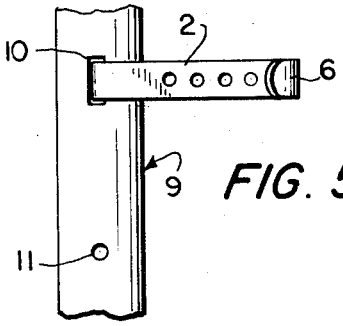
Figure 9:
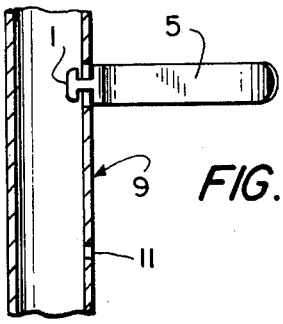
Figure 6:
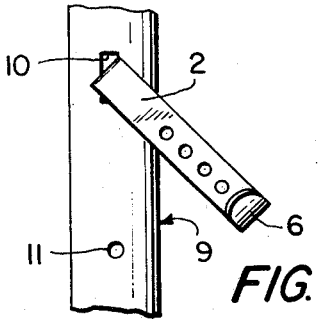
Figure 10:
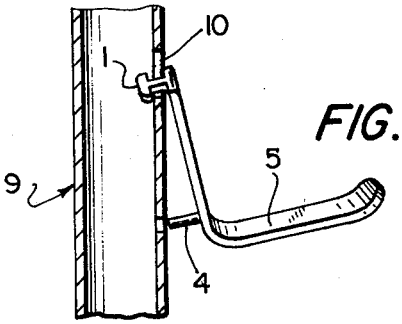
Figure 7:
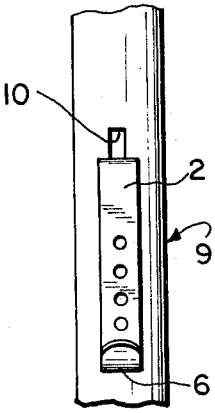

Referring to FIG. 1, a complete step is illustrated having a T-shaped protrusion 1 at the top of a vertical leg 2, a plurality of holes 3 and a pin 4 in the vertical leg 2, a horizontal leg 5 and an upturned end 6.

FIG. 1A illustrates an embodiment having a vertical leg 2*a* and a T-shaped, welded protrusion attached, by welding thereto.

Referring to FIGS. 2 and 2A, an upper plate 7 and a lower plate 8 are shown which may be attached to a mast by means of screws, bolts or the like 7*a* and 8*a* to receive the step FIG. 1.

In FIGS. 3 and 3A, a group of steps are shown in nested position for ease of storage and carrying.

FIG. 4 shows a mast 9 having a slot 10 which receives the T-shaped protrusion 1 on the top of the step and hole 11 that receives pin 4.

FIGS. 4–7 show successive views of the step being attached to or removed from the mast 9 as viewed facing slot 10 and hole 11.

FIGS. 8–11 show successive views of the step of FIG. 1 being attached or removed from mast 9 showing a cross-section view of the mast 9 at right angle to the view shown in FIGS. 4–7.

Figure 11:
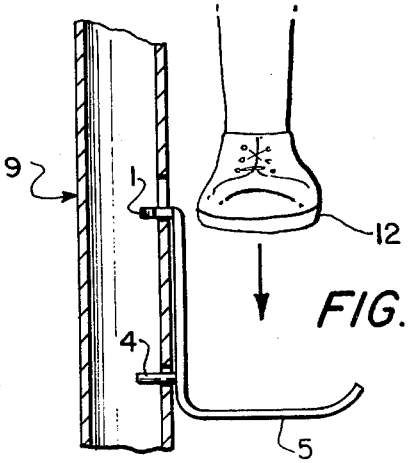

From FIG. 11 it will be appreciated that it is easy for the foot 12 to find horizontal leg 5 of the step, particularly while descending mast 9, using the mast as a guide down to its secure position on horizontal leg 5 of the step.

The steps may be used on wooden and other masts or structures by means of attaching plates 7 and 8 illustrated in FIG. 2 with appropriate holes made in the mast to receive the T-shaped protrusion 1 and pin 4 into slot 10 and hole 11, respectively, in FIG. 2. The use of these plates recessed into the mast has all the advantages mentioned except that there will be a minimum of weight added aloft because of the weight of the plates and their fastenings.

It will also be appreciated that the steps are easily removed for storage and carrying as in FIG. 3. The holes 3 in vertical leg 2 receive pin 4 of inner steps 13, allowing vertical legs 2 of the steps to be nested against each other. Pin 4 on the inner step 13 of the nested group in FIG. 3 will not require a hole 3 in outside step 14 of the nested group. Thus with a limited number of holes 3, an unlimited number of steps can be nested.

It will further be appreciated that a hollow aluminum mast 9 of the type in current use on sailboats need have no hardware attached which at once eliminates dangerous corrosion from use of dissimilar metals in mast attachments, added wind resistance, added weight aloft, protrusions that can cause fouling of lines and chafing or catching of sails and rigging, impediments to mast cleaning and refinishing, and a cluttered appearance.

There is no dependence upon welding to keep the step attached to the mast. The T-shaped protrusion 1 that secures the step to the mast 9 is an integral part of the step of FIG. 1, and not an addition welded on. Pin 4 may be welded in its hole, but in the event that the weld breaks the step will not become detached from the mast, but will remain usable though a little wobbley as it would be if pin 4 accidentally came out of hole 11.

Mast slots 10 and holes 11 may be put in the mast in a staggered fashion with one to port and the next one to starboard and so on, and at special places such as near the mast truck. Pairs of slots and holes could be at equal height and on opposite sides for pairs of steps convenient for working at the top of the mast or for a high lookout station. The same could be done lower on the mast for a lower lookout station.

All pairs of slots 10 and holes 11, or of slots alone, may be used for special attachments to the mast to hold lines for awnings, wind scoops, rain catchers, special sails or jury rigging of any kind.

Slots 10 and holes 11 will cause extremely low wind resistance, but even this may be reduced by the use of small tapes over the openings when not in use.

The upturned end 6 of the horizontal leg 5 of the step provides a guide and security for the foot as well as hook to hold bucket, a line or other items used in mast work aloft.

It will also be appreciated that slots 10 and holes 11 will not weaken the mast. Standard practice provides a weaker spot, generally at the spreaders, by providing a hole all the way through the mast with considerably greater diameter than the width of slot 10 or the diameter of hole 11, and placed in the most vulnerable spot on the mast which is at the spreader(s). This vulnerability is enhanced by the insertion of a bolt in the hole and attaching tight stays to it. The slots and holes for the attachment of steps and miscellaneous temporary fittings can be placed in the least stressed sections of the mast.

While several embodiments of the invention have been described, it will be understood that it is capable of still further modifications and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. A step comprising:

(a) a substantially vertical leg, (b) a substantially horizontal leg connected to said substantially vertical leg, (c) a generally T-shaped protrusion and a pin spaced therefrom extending from said substantially vertical leg in a direction opposite to the direction of said substantially horizontal leg, and (d) at least one hole in said substantially vertical leg positioned between said protrusion and said pin, whereby mast steps may be nested with pins of adjacent nested steps extending through a hole of at least its next adjacent step.

2. A step as defined in claim 1 wherein said protrusion is formed integral with said substantially vertical leg.

3. A step as defined in claim 1 wherein said protrusion is formed by welding a pair of substantially cylindrical pin members to form a "T" and welding the leg of the "T" to said substantially vertical leg.

4. A step as defined in claim 1 in combination with a generally vertical support member, said support member including:

(a) a slot for receiving said protrusion, and (b) a spaced apart hole for receiving said pin.

5. The combination of claim 4 wherein said slot and hole are formed on plates secured to said support member.

6. A method of providing a sailboat mast with detachable, nestable steps comprising:

(a) providing a mast with a plurality of spaced apart slots and holes, (b) providing a plurality of steps with a T-shaped protrusion and a spaced apart pin on a leg thereof, (c) turning said step at an angle of about 90° C. to said mast, (d) inserting said T-shaped protrusion into said slot, (e) rotating said step to substantially parallel to said mast, and (f) inserting said pin in said hole.

7. The method of claim 6 including providing said leg with at least one hole between said protrusion and said pin.

8. The method of claim 2 including nesting said steps when removed from said mast by inserting the pin of one step into the hole of at least the next adjacent step in tne nested group.

* * * * *